US005483885A

United States Patent [19]

Leineweber

[11] Patent Number: 5,483,885

[45] Date of Patent: Jan. 16, 1996

[54] HOLDER FOR A DOCTOR ROD

[75] Inventor: Heinz Leineweber, San Fernando de Maspalomas, Spain

[73] Assignee: Jagenberg Papiertechnik GmbH, Neuss, Germany

[21] Appl. No.: 321,429

[22] Filed: Oct. 11, 1994

[30] Foreign Application Priority Data

Oct. 11, 1993 [DE] Germany ..... 43 34 555.7

[51] Int. Cl.[6] ..... B41F 9/10

[52] U.S. Cl. ..... 101/169; 101/365; 101/120

[58] Field of Search ..... 101/119, 120, 101/160, 161, 167–169, 123, 124, 365

[56] References Cited

U.S. PATENT DOCUMENTS

| | | | |
|---|---|---|---|
| 3,701,335 | 10/1972 | Barnscheidt | 101/120 X |
| 4,119,836 | 10/1978 | Motokawa | 101/365 X |
| 4,789,432 | 12/1988 | Goodnow et al. | 101/169 X |

FOREIGN PATENT DOCUMENTS

| | | |
|---|---|---|
| 2410875 | 9/1975 | Germany . |
| 3022955 | 12/1981 | Germany . |
| 8232839.0 | 6/1984 | Germany . |
| 3620374 | 2/1987 | Germany . |
| 3934418 | 4/1991 | Germany . |
| 9103571.6 | 9/1992 | Germany . |
| 9112032.2 | 3/1993 | Germany . |

*Primary Examiner*—Christopher A. Bennett
*Attorney, Agent, or Firm*—Herbert Dubno; Andrew Wilford

[57] ABSTRACT

In an applicator a thick coating of a liquid is applied to a flexible web that is then moved through a doctor assembly where excess liquid is scraped from the web. The doctor assembly has a generally stationary support at the station and a holder beam extending longitudinally substantially parallel to the web and transverse to a web travel direction. The beam is movable on the support transversely of itself and of the travel direction forward toward and backward away from the web and has a front face directed toward the web and an opposite back face turned away from the web. The support has front and back faces generally parallel to and respectively confronting the front and back faces of the holder beam. A doctor rod held in the holder beam is juxtaposable thereby with the web to scrape the excess liquid from the web. Front inflatable hoses are provided between the front faces of the holder beam and support and back inflatable hoses between the back faces of the holder beam and support. These hoses can be selectively inflated and deflated so that when the front hose is inflated at greater pressure than the back hose the holder beam moves backward in the support and when the back hose is inflated at greater pressure than the front hose the holder beam moves forward in the support.

4 Claims, 2 Drawing Sheets

HOLDER FOR A DOCTOR ROD

FIELD OF THE INVENTION

The present invention relates to a doctor assembly for applying a liquid to a moving web. More particularly this invention concerns a holder for a doctor rod of such an assembly.

BACKGROUND OF THE INVENTION

In various manufacturing operations it is standard to coat a web substrate, typically of paper, with a thick layer of a liquid that is subsequently dried and hardened, and to control the thickness of the liquid layer by passing the web through a doctor assembly before the liquid dries. In this doctor assembly a doctor rod is held at a meticulously controlled spacing from the surface of the coated web so that it strips off excess liquid and leaves the web with a coating of the exact required thickness.

German patent documents 2,410,875 of Kreienbrink, 3,022,955 and 3,620,374 of Pullinen, and 3,934,418 of Beisswanger as well as German utility models 8,232,839, 9,103,571, and 9,112,032 and copending and commonly owned U.S. patent application Ser. No. 08/140,125 of Meyer describe various doctor assemblies that function as described above. In such systems it is standard to provide an elastic mounting for the doctor rod in the form of an inflatable hose braced between a back face of a holder beam carrying the rod and a front face of a stationary support. Such a system is not ideal at high web speeds since the hose cannot itself exert sufficient force to achieve the desired tight control.

OBJECTS OF THE INVENTION

It is therefore an object of the present invention to provide an improved doctor system for a liquid applicator.

Another object is the provision of such an improved doctor system for a liquid applicator which overcomes the above-given disadvantages, that is which can work accurately even at very high web speeds.

SUMMARY OF THE INVENTION

In an applicator a thick coating of a liquid is applied to a flexible web that is then moved through a doctor assembly where excess liquid is scraped from the web. The doctor assembly has according to the invention a generally stationary support at the station and a holder beam extending longitudinally substantially parallel to the web and transverse to a web travel direction. The beam is movable on the support transversely of itself and of the travel direction forward toward and backward away from the web and has a front face directed toward the web and an opposite back face turned away from the web. The support has front and back faces generally parallel to and respectively confronting the front and back faces of the holder beam. A doctor rod held in the holder beam is juxtaposable thereby with the web to scrape the excess liquid from the web. According to the invention front inflatable hoses are provided between the front faces of the holder beam and support and back inflatable hoses between the back faces of the holder beam and support. These hoses can be selectively inflated and deflated so that when the front hose is inflated at greater pressure than the back hose the holder beam moves backward in the support and when the back hose is inflated at greater pressure than the front hose the holder beam moves forward in the support.

Thus it is not only possible to exert a pressure against the web and the support roller it is normally spanned over, but to also exert a counter pressure. Thus the profile can be set independent of the pressing force with a finely settable profile device. The counter pressure created by the front hose or hoses can mimic the outwardly effective force of the liquid on the web. In particular it is possible to lower the pressure in order to leave a relatively thick coating on the web without this coating being uneven as is the case with prior-art systems operating at low pressure.

According to the invention the holder beam has two such front faces and two such rear faces and the support similarly has two such front faces and two such back faces. The holder beam is formed relative to the direction with a pair of laterally oppositely directed feet each forming a respective one of the front faces and a respective one of the back faces. The assembly has two such front hoses and two such back hoses at the respective faces.

In addition the assembly can be provided with a bendable adjustment bar engaged between the support and the holder beam and extending the full length of the beam and with a plurality of adjustment devices spaced longitudinally along the bar and support for displacing respective sections of the bar relative to the support toward and away from the web.

The holder according to the invention is generally T-shaped and has a central leg which carries the rod and a pair of arms forming the respective faces. The front hoses flank the leg of the T.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
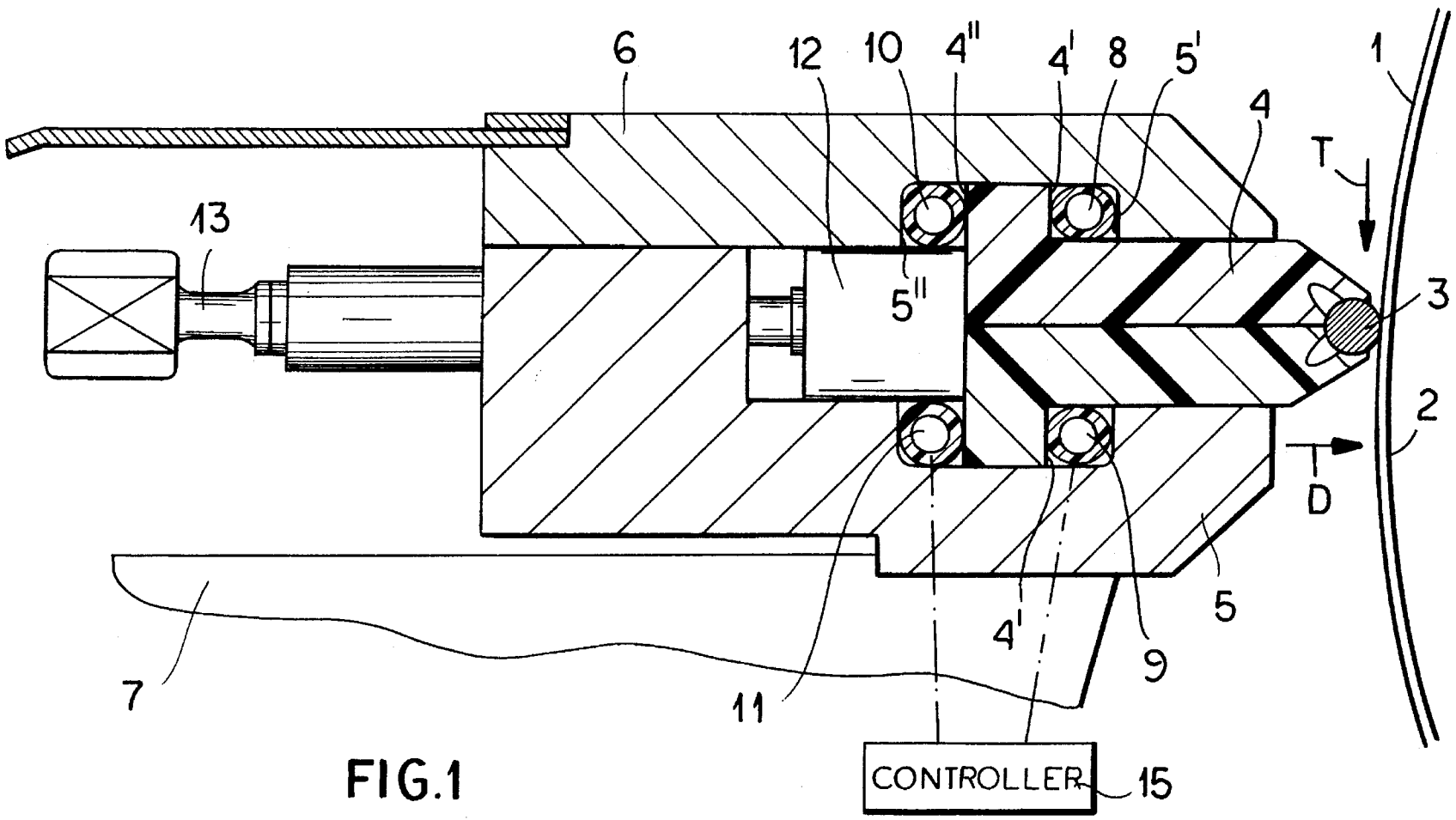
FIG. 1 is a large-scale largely schematic vertical section through the applicator assembly of this invention.

As seen in FIG. 1 a paper web 1 spanned over a roller 2 rotated continuously about its horizontal axis moves in a travel direction T past a coating station defined by a circular-section metallic applicator rod 3 secured in a T-section flexible holder beam 4. The beam 4 in turn can move in a direction D radially of the roller 2 in a support 5 fixed on a pivotal base 7 and having a cover part 6. The support 5 and cover 6 define a chamber in which front and back faces 4' and 4" of the holder beam 4 confront respective back and front faces 5' and 5" of the support 5, these faces 4', 4", 5', and 5" all being perpendicular to the direction D. Hoses 8 and 9 extending parallel to the support beam 4 are positioned between each front holder face 4' and the respective support face 5' and further hoses 10 and 11 are positioned between the back holder faces 4" and the back support faces 5". A schematically illustrated controller 15 can supply gas under pressure to these hoses 9–11 selectively, the hoses 8 and 9 being pressurized and depressurized together like the hoses 10 and 11. The web 1 is about 8 m wide and the rod 3 has a diameter of about 12 mm. The holder 4 is formed of an elastomeric material of two identical parts with a Shore hardness of 80 and joined on a central symmetry plane.

Figure 2:
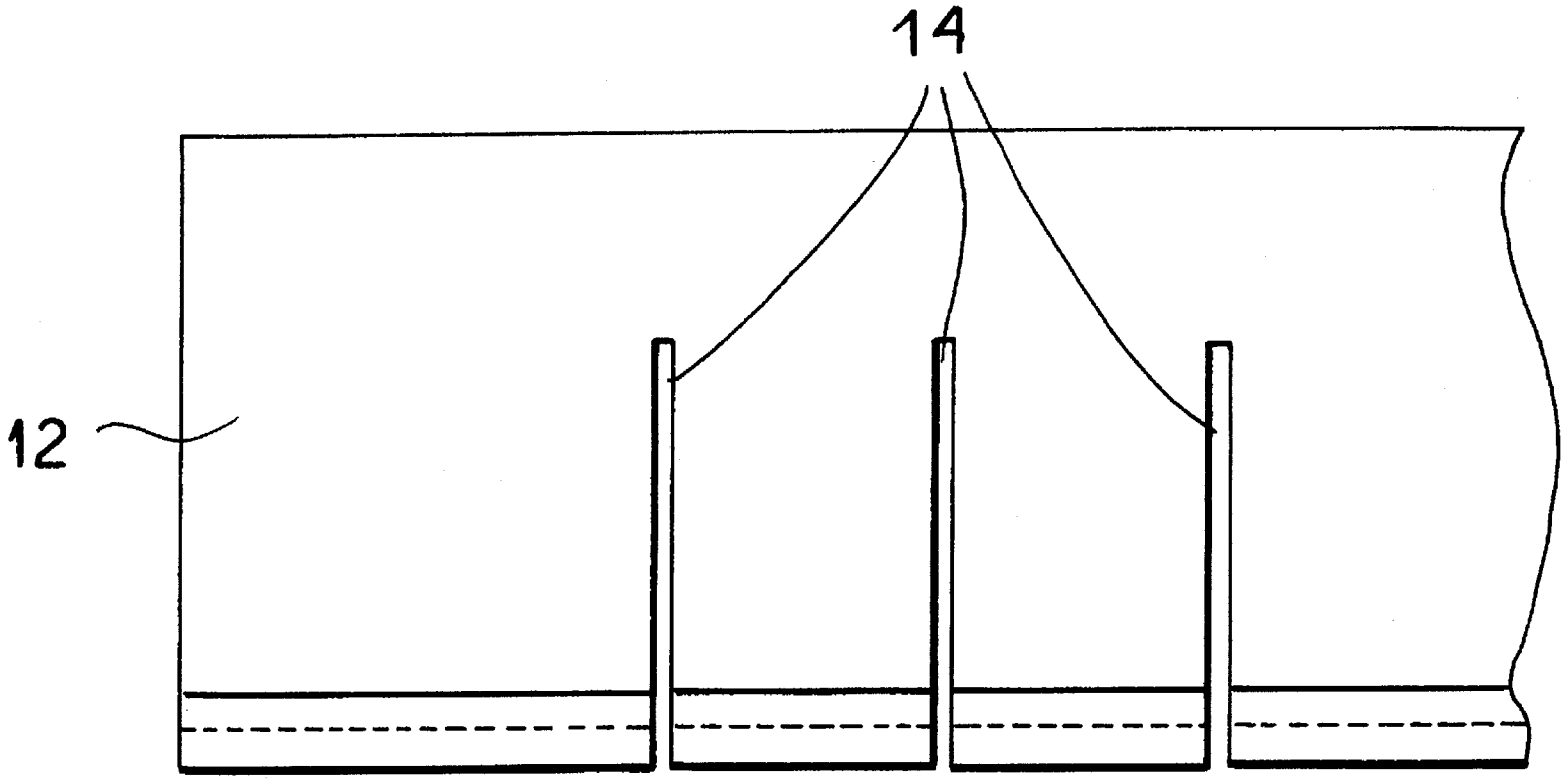
FIG. 2 is a top view of a detail of FIG. 1.

A metallic adjustment bar 12 extending the full length of the holder beam 4 bears forward against its back face 4" and is in turn braced against the support 5 by a plurality of longitudinally spaced threaded spindle adjusters 13. The bar 12 is made of steel but is transversely split at 14 as indicated in FIG. 2 so it can flex somewhat, allowing it to be bent relatively easily.

To start with, pressure is built up in the front hoses 8 and 9 and the holder 5 is swung toward the roller 2 and the adjusters 13 are operated to get the rod 3 perfectly parallel to the surface of the roller 2. Then operation is started, with the web 1 moving with the periphery of the roller 2 and picking up a substantial load of treatment liquid upstream in direction T from the rod 3. The basic coating thickness is initially established by appropriately positioning the support 7.

Then the hoses 8 and 9 are deflated while the hoses 10 and 11 are inflated. The thus produced decrease in the gap between the rod 3 and the web 1 is compensated for by a backward movement of the support 7. After this adjustment the desired coating thickness can be set by varying the pressure in the hose pairs 8, 9 and 10, 11. Pressurization of the hoses 8 and 9 allows the coating depth to be determined very accurately by the difference between the pressures in the front hoses 8 and 9 and the back hoses 10 and 11.

Of course this same device would work just as well in applying a uniform coating to a roller for subsequent transfer to a web, in which case the transfer roller could be considered the web as discussed herein.

I claim:

1. In an applicator where a thick coating of a liquid is applied to a flexible web that is then moved through a doctor assembly where excess liquid is scraped from the web, the doctor assembly comprising:

a generally stationary support at the station;

a holder beam extending longitudinally substantially parallel to the web and transverse to a web travel direction, the beam being movable on the support transversely of itself and of the travel direction forward toward and backward away from the web and formed relative to the direction with a pair of laterally directed feet each forming a respective front holder face directed toward the web and a respective oppositely directed back holder face turned away from the web, the support having respective front and back support faces generally parallel to and confronting the respective back and front holder faces;

a doctor rod held in the holder beam and juxtaposable thereby with the web to scrape the excess liquid from the web;

respective front inflatable hoses each engaged between a respective one of the front holder faces and the respective back support face;

respective back inflatable hoses each engaged between a respective one of the back holder faces and the respective front support face; and means for selectively inflating and deflating the hoses, whereby when the front hoses are inflated at greater pressure than the back hoses the holder beam moves backward in the support and when the back hoses are inflated at greater pressure than the front hoses the holder beam moves forward in the support.

2. The doctor assembly defined in claim 1, further comprising:

a bendable adjustment bar engaged between the support and the holder beam and extending the full length of the beam; and means including a plurality of adjustment devices spaced longitudinally along the bar and support for displacing respective sections of the bar relative to the support toward and away from the web.

3. The doctor assembly defined in claim 2 wherein the front hoses flank the holder.

4. The doctor assembly defined in claim 2 wherein the holder is generally T-shaped and has a central leg which carries the rod and a pair of arms forming the respective holder faces.

* * * * *